US008444101B2

(12) United States Patent
Holman

(10) Patent No.: US 8,444,101 B2
(45) Date of Patent: May 21, 2013

(54) APPARATUS, DEVICE, AND SYSTEM FOR ADJUSTABLE STORAGE

(76) Inventor: Jeffrey T Holman, Farmington, UT (US)

( * ) Notice: Subject to any disclaimer, the term of this patent is extended or adjusted under 35 U.S.C. 154(b) by 299 days.

(21) Appl. No.: 12/986,983

(22) Filed: Jan. 7, 2011

(65) Prior Publication Data

US 2012/0006961 A1 Jan. 12, 2012

Related U.S. Application Data

(60) Provisional application No. 61/293,036, filed on Jan. 7, 2010.

(51) Int. Cl.
*A47H 1/10* (2006.01)

(52) U.S. Cl.
USPC ..... 248/328; 248/320; 248/693; 24/68 CD

(58) Field of Classification Search
USPC 248/342, 328, 320, 317, 558, 693; 24/68 CD
See application file for complete search history.

(56) References Cited

U.S. PATENT DOCUMENTS

| | | | | | |
|---|---|---|---|---|---|
| 3,173,539 | A * | 3/1965 | Looker | 206/597 |
| 3,940,553 | A * | 2/1976 | Hawkins | 174/42 |
| 4,101,109 | A * | 7/1978 | Edwards | 248/317 |
| 4,332,252 | A * | 6/1982 | Taylor | 604/322 |
| 5,393,025 | A * | 2/1995 | Franklin | 248/317 |
| 5,440,790 | A * | 8/1995 | Chou | 24/302 |
| 5,608,951 | A * | 3/1997 | Chou | 24/302 |
| 5,709,014 | A * | 1/1998 | Takahashi | 24/614 |
| 6,170,133 | B1 * | 1/2001 | Uehara | 24/614 |
| 6,711,790 | B2 * | 3/2004 | Pontaoe | 24/633 |
| 6,986,491 | B2 * | 1/2006 | Anderson | 248/317 |
| 7,243,928 | B2 * | 7/2007 | Singer | 280/47.331 |
| 7,575,214 | B2 * | 8/2009 | Badalament | 248/328 |
| 7,810,655 | B2 * | 10/2010 | Wang | 211/118 |
| 7,849,568 | B2 * | 12/2010 | Wilkinson | 24/298 |
| 7,950,532 | B2 * | 5/2011 | Ziaylek et al. | 211/30 |
| 8,132,302 | B2 * | 3/2012 | Wilkinson | 24/302 |
| 8,181,835 | B2 * | 5/2012 | Thatcher | 224/631 |
| 8,241,089 | B2 * | 8/2012 | Otto | 450/86 |
| 2004/0031898 | A1 * | 2/2004 | Mijatovic | 248/330.1 |
| 2005/0269475 | A1 * | 12/2005 | Parker | 248/317 |
| 2006/0017246 | A1 * | 1/2006 | Singer | 280/47.331 |
| 2006/0180728 | A1 * | 8/2006 | Abrantes | 248/328 |
| 2008/0047501 | A1 * | 2/2008 | Madere et al. | 119/863 |
| 2009/0137371 | A1 * | 5/2009 | Fuller | 482/122 |
| 2010/0285939 | A1 * | 11/2010 | Latronica | 482/139 |

* cited by examiner

*Primary Examiner* — Bradley Duckworth
(74) *Attorney, Agent, or Firm* — Jeffrey T. Holman

(57) ABSTRACT

An apparatus for hanging a storage device comprising a mounting strap, a frontal strap, a lower strap and a connector. The frontal strap is oriented to support the storage device and at least partially wrap around the storage device. The lower strap is configured to at least partially wrap around a bottom portion of the storage device. The connector has multiple connection points and is configured to connect the mounting strap, frontal strap, and lower strap.

15 Claims, 14 Drawing Sheets

APPARATUS, DEVICE, AND SYSTEM FOR ADJUSTABLE STORAGE

CROSS-REFERENCE TO RELATED APPLICATIONS

This application claims the benefit of U.S. Provisional Application No. 61/293,036, filed on Jan. 7, 2010, which is incorporated by reference herein in its entirety.

BACKGROUND

Storage of items, materials, or substances is common in many industrial and residential applications. Items that may be stored together are often of varying size and weight. Conventional storage systems, such as standard shelving, do not often accommodate the size and weight variance of each stored item in an efficient manner. Conventional systems accommodate a certain geometry and/or weight. For example, a conventional shelf has a certain amount of useable surface area. That surface area can generally hold a given amount of weight that is dictated by the strength and materials which make up the support structure of the shelf. If items to be stored are all of a single geometry, the shelf can be made to accommodate the items easily. However, if the items that are to be stored on the shelf are of varying weight and size, the shelf is not an efficient system for storing the items.

Many items that are stored are items that are sensitive to moisture, heat, or vulnerable to insects or rodents. Conventionally, these sensitive items are stored within a sealable or protective package. However, some of these packages are not sized to fit conventional storage systems. For example, a plastic bin used to prevent rodents and insects from damaging an item may have a geometric dimension that complicates the storage of the item while in the protective bin. Similarly, the bin may have a different geometry when compared to other items that may be stored on the same shelf. The shelf might be adjusted to accommodate the bin but the adjustment may reduce the total number of shelves that may be used or the overall surface area available for storage.

Additionally, while conventional shelves are adjustable in the sense that they can be installed at various heights or adjusted as a whole, conventional shelving does not allow individual adjustment for separate items that are to be stored on the shelf. Furthermore, some bins and protective packaging are designed to facilitate stacking multiple units with or without a shelving system. However, in the situation that several units are stacked, if the item sought is located in the unit on the bottom of a stack of multiple units or has one or more units stacked on top of it, the units stacked on top of the item must be removed from the unit containing the item in order to retrieve the item.

SUMMARY

Embodiments described herein include an apparatus, device, and system for adjustable storage using novel designs that increase versatility over conventional designs. Embodiments of the design are expected to have relatively low capital cost and high durability and weight capacity. The elements of the design in combination provide storage feasibility for private and commercial applications.

Embodiments of the invention relate to an apparatus for hanging. The apparatus includes a first strap, a second strap, a third strap, and a connector. The second strap is oriented to support the item from substantially beneath an item. The third strap is oriented to support the item from at least one substantial side portion of the item. The connector connects the first, second, and third straps.

Embodiments of the invention relate to a storage system. The storage system includes a mounting rail, at least one attachment device, and a storage apparatus. The at least one attachment device interfaces with the mounting rail. The storage apparatus includes at least one mounting strap, a frontal strap, a lower strap, and a connector. The at least one mounting strap is coupled to the attachment device. The connector couples to the at least one mounting strap, the frontal longitudinally strap, and the lower strap. Other embodiments for storage systems are also described.

Embodiments of the invention relate to a device. The device includes a mounting attachment structure, a lower attachment structure, and a frontal attachment structure. The mounting attachment structure attaches at least one strap to the device. The lower attachment structure attaches at least a second strap to the device and is oriented at a first angle with respect to the mounting attachment structure. The frontal attachment structure is oriented at a second angle from the mounting attachment structure and to attach at least a third strap to the device. The mounting attachment structure, the lower attachment structure, and the frontal attachment structure each include means for securing the straps.

BRIEF DESCRIPTION OF THE DRAWINGS

Throughout the description, similar reference numbers may be used to identify similar elements.

DETAILED DESCRIPTION

Figure 1:
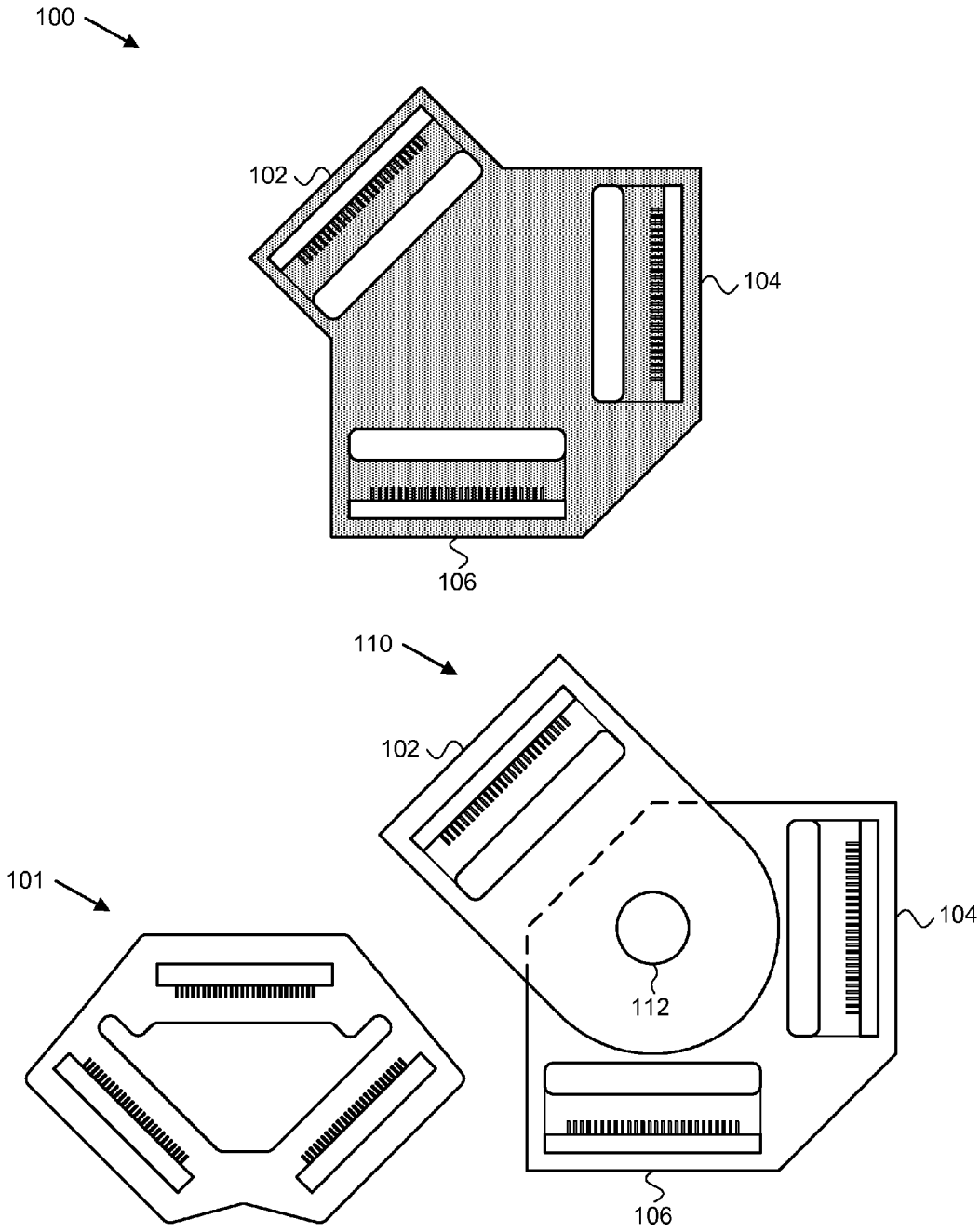
FIG. 1 depicts a schematic diagram of several embodiments of a connector device.

In the following description, specific details of various embodiments are provided. However, some embodiments may be practiced with less than all of these specific details. In other instances, certain methods, procedures, components, structures, and/or functions are described in no more detail than to enable the various embodiments of the invention, for the sake of brevity and clarity.

It will be readily understood that the components of the embodiments as generally described herein and illustrated in the appended figures could be arranged and designed in a wide variety of different configurations. Thus, the following more detailed description of various embodiments, as represented in the figures, is not intended to limit the scope of the present disclosure, but is merely representative of various embodiments. While the various aspects of the embodiments are presented in drawings, the drawings are not necessarily drawn to scale unless specifically indicated.

The present invention may be embodied in other specific forms without departing from its spirit or essential characteristics. The described embodiments are to be considered in all respects only as illustrative and not restrictive. The scope of the invention is, therefore, indicated by the appended claims rather than by this detailed description. All changes which come within the meaning and range of equivalency of the claims are to be embraced within their scope.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussions of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize, in light of the description herein, that the invention can be practiced without one or more of the specific features or advantages of a particular embodiment. In other instances, additional features and advantages may be recognized in certain embodiments that may not be present in all embodiments of the invention.

Reference throughout this specification to "one embodiment," "an embodiment," or similar language means that a particular feature, structure, or characteristic described in connection with the indicated embodiment is included in at least one embodiment of the present invention. Thus, the phrases "in one embodiment," "in an embodiment," and similar language throughout this specification may, but do not necessarily, all refer to the same embodiment.

While many embodiments are described herein, at least some embodiments of the invention include a device, apparatus, and system for storage. In this description, references to an "item" refer to any substance or structure that may be contained or stored either singularly or in a plurality. For example, it may refer to a single structure, several structures of the same type, a collection of different structures together, or a fluid, or other substance.

FIG. 1 shows a simple schematic of one embodiment of a fixed connector device 100 of the present invention. In the illustrated embodiment, the connector 100 includes a mounting attachment structure 102, a frontal attachment structure 104, and a lower attachment structure 106. As illustrated, the attachment structures 102, 104, and 106, are configured for use with a strap or substantially planar element. In the illustrated embodiment, the attachment structures 102, 104, and 106 are configured with binding edges to bind a strap within each of the attachment structures 102, 104, and 106 individually. Other embodiments of the connector 100 may be configured for use with an element of another cross-sectional geometry. For example, other embodiments of the connector device 100 might be configured for use with string, wire, cable, tube, barstock, chain, or other elements. Additionally, the connector 100 may include fewer or more attachment structures to facilitate the attachment of fewer or more straps or other elements. In the illustrated embodiment, the attachment structures 102, 104, and 106 are strap adjusters with multiple points of contact and/or crossbars for a strap to bind against or wrap around in connecting to the connector 100. Furthermore, attachment structures 102, 104, and 106 may be a variety of structures, such as buckles, slides, single or multiple loop attachments, strap adjusters, cord locks, snap hooks, d-rings, or other similar devices.

FIG. 1 also illustrates another embodiment of the connector 100 as the adjustable connector 110. The illustrated embodiment of the adjustable connector 110 is similar to the fixed connector 100 and includes the mounting attachment structure 102, frontal attachment structure 104, and lower attachment structure 106 as described above. The adjustable connector 110 also includes a pivot structure 112. The pivot structure 112 allows the mounting attachment structure 102 to move with respect to the frontal and lower attachment structures 104 and 106. In other embodiments, each of the attachment structures 102, 104, and 106, are independently moveable with respect to one another. Some embodiments of the pivot structure 112 include a bearing or other low-friction element to allow the adjustable connector 110 to move freely. Other embodiments of the pivot structure 112 are high-friction or lockable to facilitate a rigid adjustment of the pivot structure 112.

Figure 2:
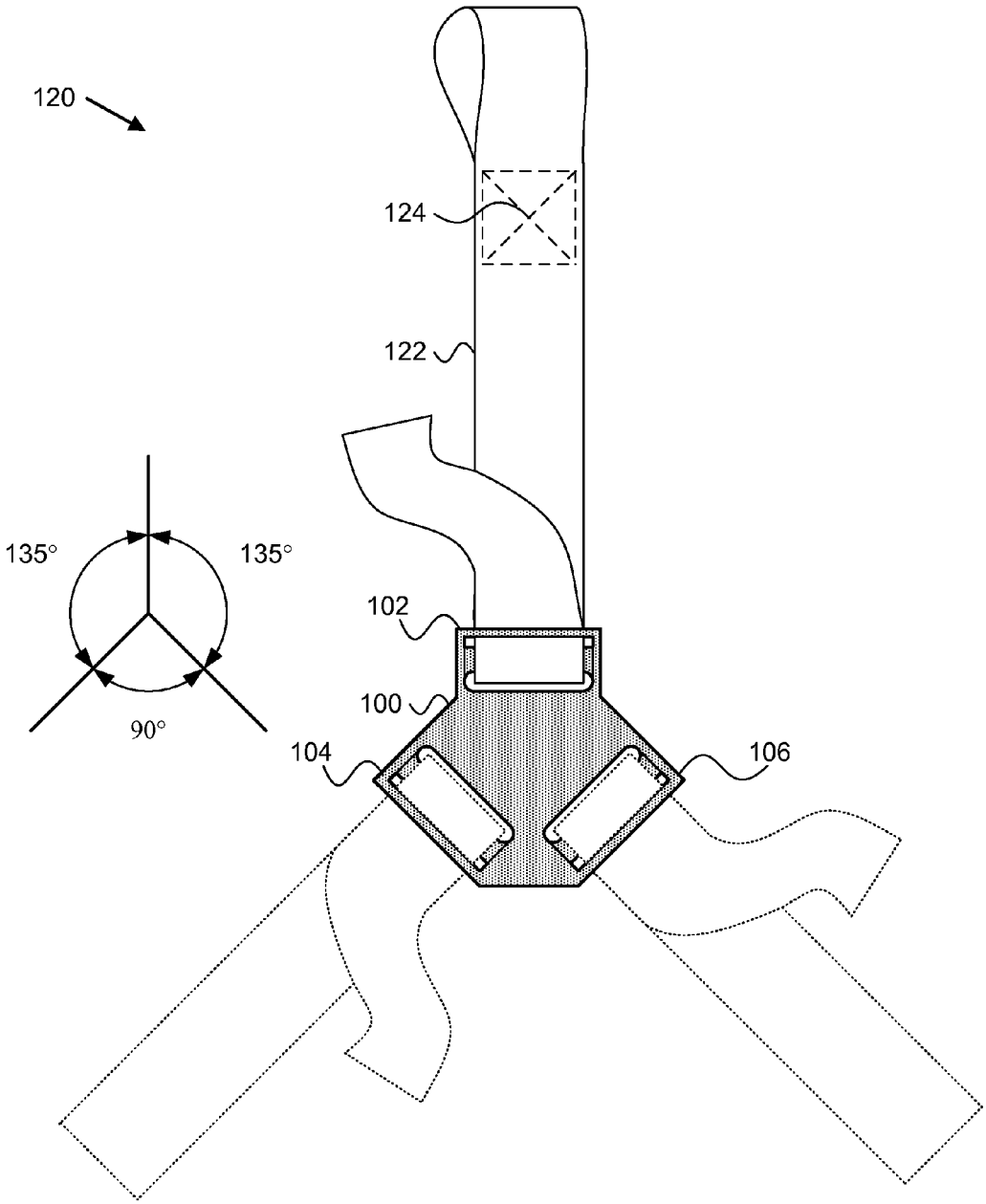
FIG. 2 depicts a schematic diagram of one configuration of the connector with straps.

FIG. 2 depicts a simple schematic of one configuration of the connector 100. The depicted embodiment illustrates the connector 100 with straps connected to the attachment structures 102, 104, and 106. Particularly, FIG. 2 shows a mounting strap 122 attached to the mounting structure 102. The mounting strap 122 includes a sewn portion 124. The sewn portion 124 forms at loop in one end of the mounting strap 122. In other embodiments, the mounting strap 122 includes a bonded portion formed through an application of heat or an adhesive. In other embodiments, the mounting strap 122 is manufactured with a loop formed in the strap 122 so that no modification is required to form the loop.

FIG. 2 also illustrates one embodiment of an angle orientation for the connector 100. The depicted embodiment shows the frontal and lower attachment structures 104 and 106 at a relative orientation of 90° from one another. As illustrated, the mounting attachment structure 102 is at a relative orientation of 135° from each of the frontal and lower attachment structures 104 and 106. Other embodiments may incorporate other angles. For example, in some embodiments, different angles may allow the straps to have improved contact with the attachment structures 102, 104, and 106 while under load. Other embodiments may incorporate other angles to facilitate the shape or size of the strap.

Figure 3:
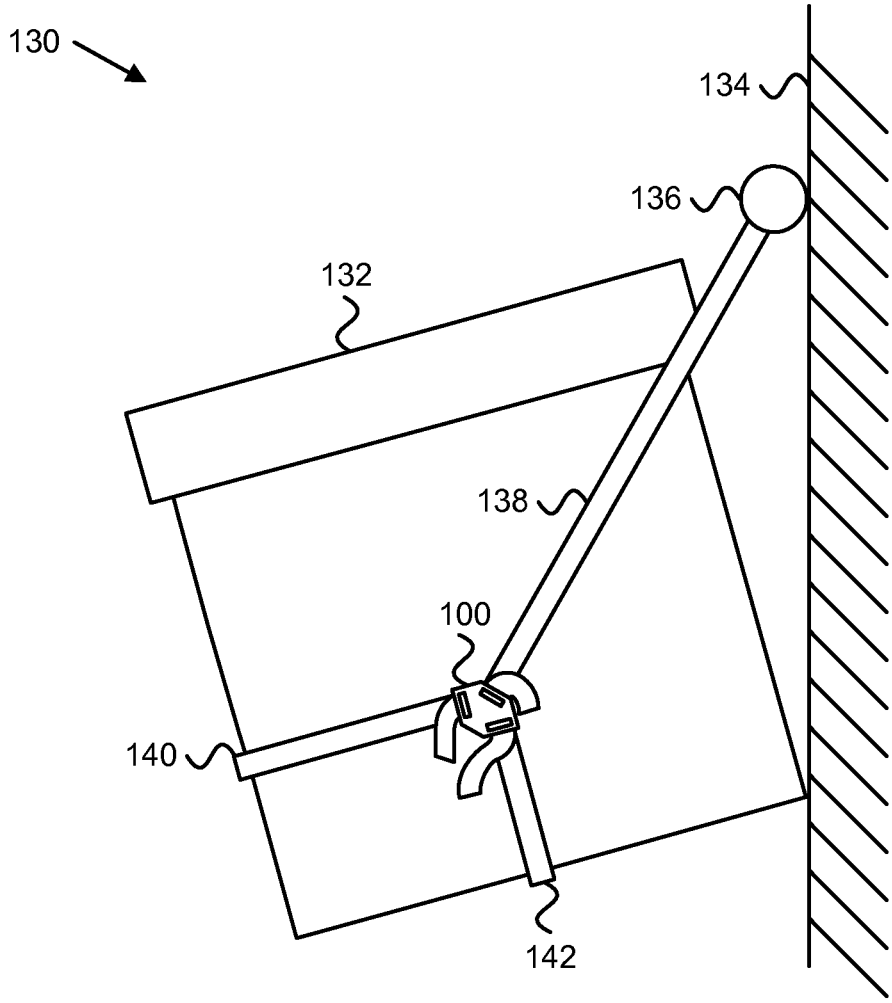
FIG. 3 depicts a schematic diagram of a storage system with straps and a storage device.

FIG. 3 illustrates a schematic of a storage system 130. The illustrated embodiment of the storage system 130 facilitates mounting of the box 132 to a wall or other at least semi-vertical surface 134. The system 130 is coupled to the wall 134 via mounting means 136 (some embodiments of the mounting means 136 described in further detail below). A mounting member 138 is coupled to the mounting means 136. The mounting member 138 is coupled to the connector 100 of FIG. 1. In some embodiments, the mounting member 138 is adjustably coupled to the connector 100. In the illustrated embodiment, the connector 100 is also connected to a frontal member 140. The frontal member 140 is configured to at least partially wrap around a side of the box 132 and provide a restraining force to maintain the box 132 in a substantially upright position. The connector 100 is also coupled to a lower member 142. The lower member 142 at least partially wraps around a bottom surface of the box 132. The lower member 142 is configured to apply a substantially upward force on the box 132 when the box 132 is in the position illustrated in FIG. 3. In some embodiments, another connector (not shown) is included on the reverse side of the box 132 with a similar arrangement of the frontal and lower members 140 and 142 and a similar mounting member 138 and mounting means 136.

As illustrated in FIG. 3, the box 132 may be stored with a single edge of the box 132 in contact with the wall 134. In other embodiments, the box 132 could have multiple points of contact with the wall 134. In some embodiments, the mounting, frontal, and lower members 138, 140, and 142 are loaded in tension. Other embodiments use other loading arrangements.

Figure 4:
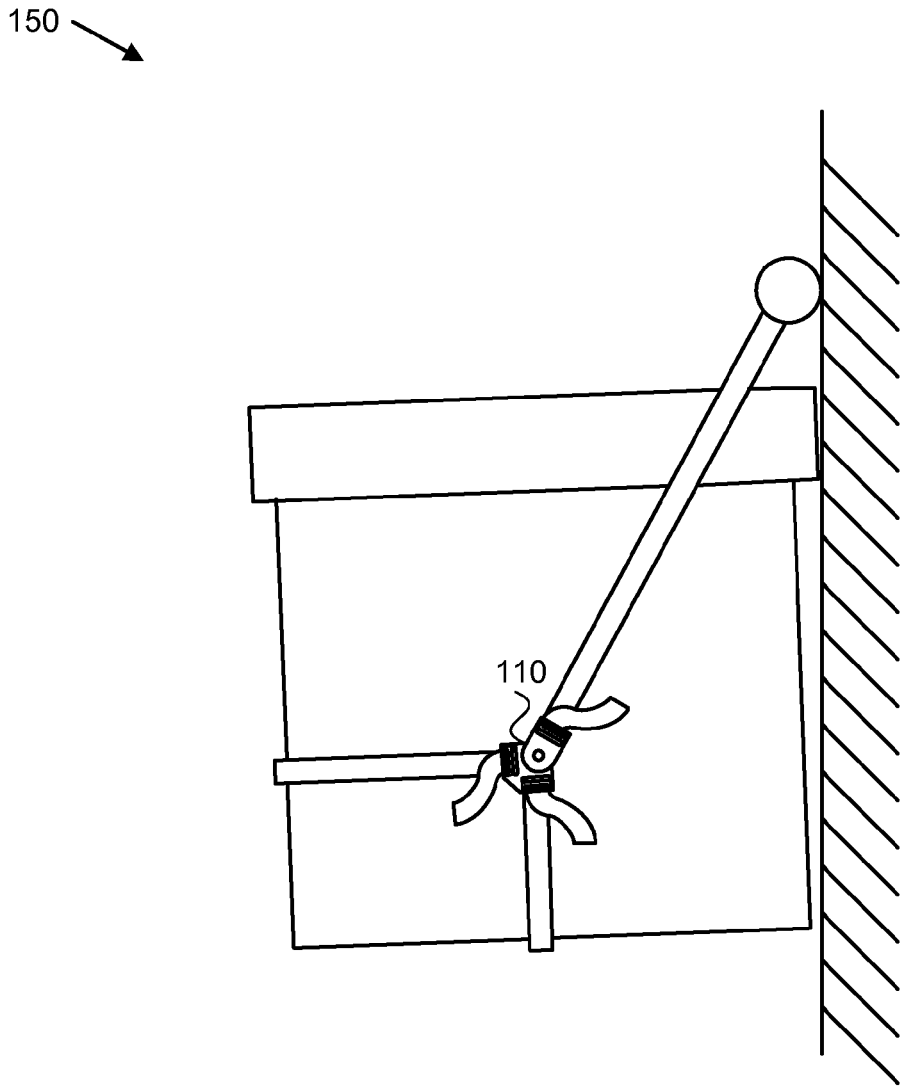
FIG. 4 depicts a schematic diagram of a storage system with straps and a storage device.

FIG. 4 illustrates a similar embodiment to that illustrated in FIG. 3. FIG. 4 includes the adjustable connector 110 to allow a variable degree difference between the mounting points of the adjustable connector 110. In some embodiments, the adjustable connector 110 provide versatility in box size and contact angle with the wall 134.

Figure 5:
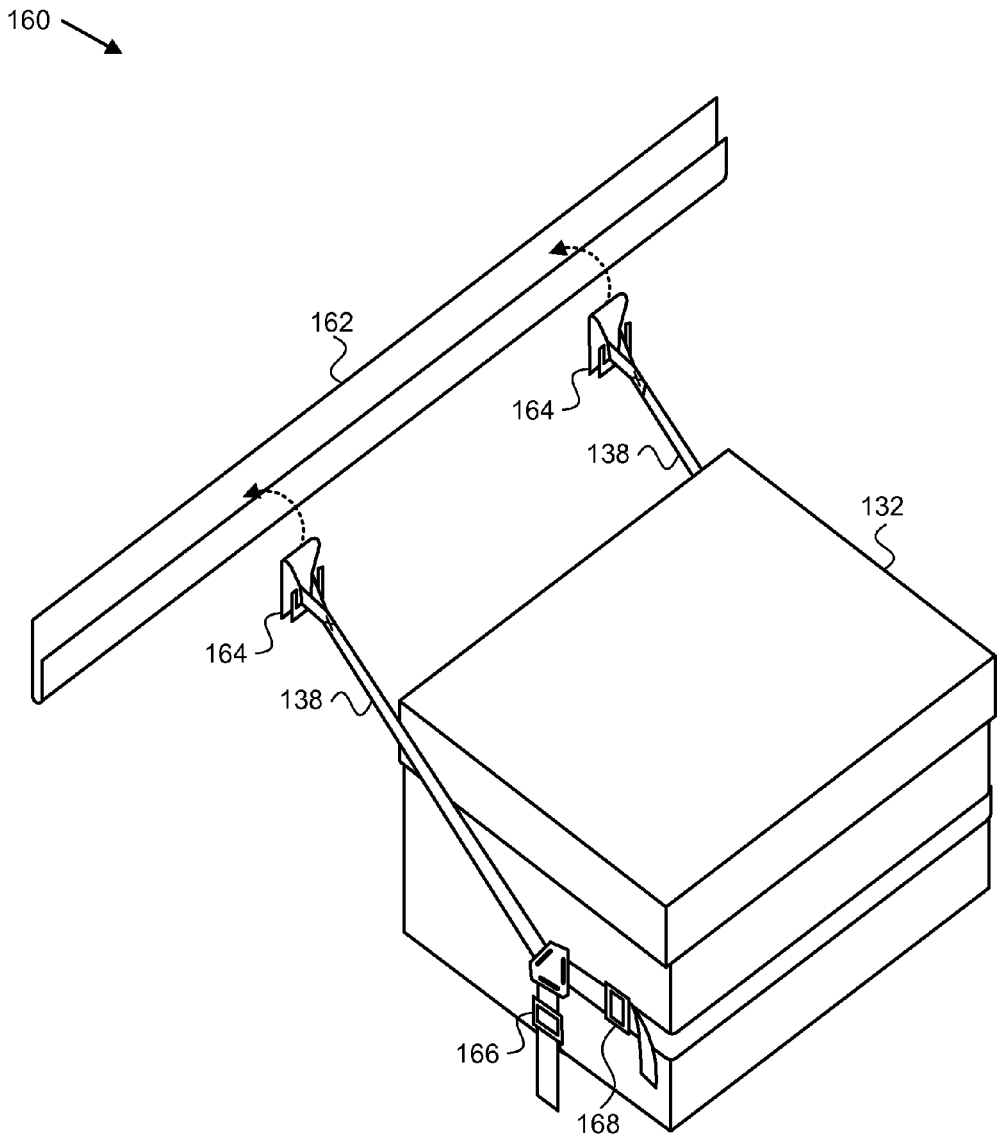
FIG. 5 depicts a schematic diagram of a storage system with straps, a storage device, and a mounting device.

FIG. 5 illustrates one embodiment of a storage arrangement 160 for hanging the box 132. In the illustrated embodiment, a channel beam 162 is mounted to a wall or other surface. Clips 164 are configured to attach to the channel beam 162. In the illustrated embodiment, the clips 164 have a geometry to allow the mounting members 138 to removably couple to the clips 164. Other embodiments include the mounting members 138 fixed to the clips 164. In some embodiments, the clips 164 are configured to facilitate the hanging and removal of the box 132 and the rest of the storage arrangement 160 from the channel beam 162. The illustrated embodiment of the storage arrangement 160 also includes a lower member retainer 166 and a frontal member retainer 168. In some embodiments, the retainers 166 and 168 are simple "figure eights." In other embodiments, the retainers 166 and 168 have binding surfaces to bind on the frontal and lower members 140 and 142. In some embodiments, the retainers 166 and 168 provide additional adjustability and support to the connector 100. In other embodiments, the retainers 166 and 168 are configured to adjust the length of the frontal and lower members 140 and 142. In other embodiments, the retainers 166 and 168 facilitate adjustment while the connector 100 is a simple weight-bearing element such as a steel ring or other weight-bearing structure. Furthermore, while not included in the illustrated embodiment, the storage arrangement for hanging the box may also include an additional wrapping strap that wraps around the back of the box 132 or the perimeter of the box 132, providing additional stability and support for the box 132.

Figure 6:
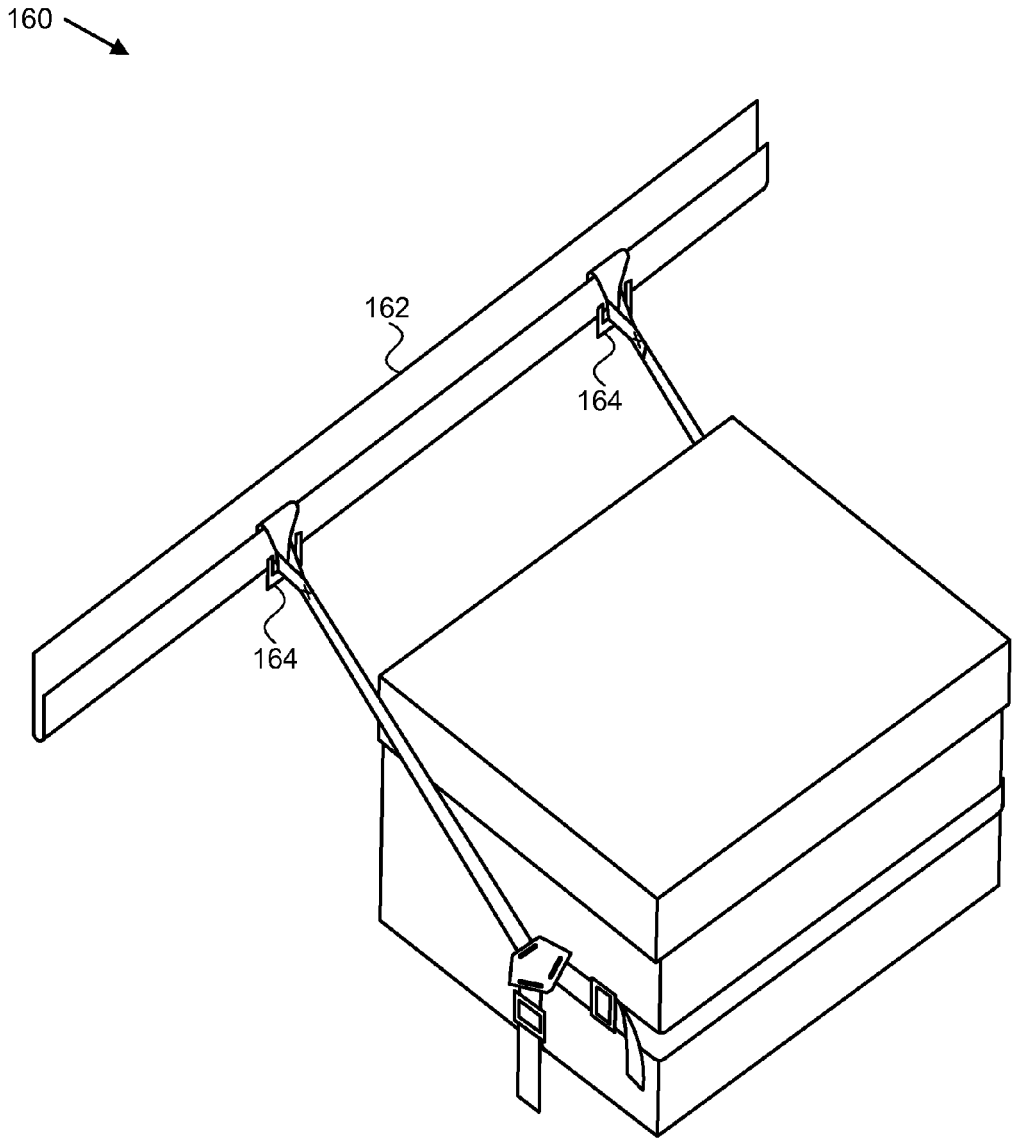
FIG. 6 depicts a schematic diagram of a storage system with straps, a storage device, and a mounting device in a mounted configuration.

FIG. 6 illustrates the storage arrangement 160 of FIG. 5 with the clips 164 engaged with the channel beam 162. In the illustrated embodiment, the clips 164 simply hang on the channel beam 162. However, other embodiments may incorporate other means for attaching to the channel beam 162. For example, other means for attaching to the channel beam 162 may include magnets, sliders, lockable sliders, clamps, rollers, hooks, blocks, or other mechanical interfacing or hanging devices.

Figure 7:
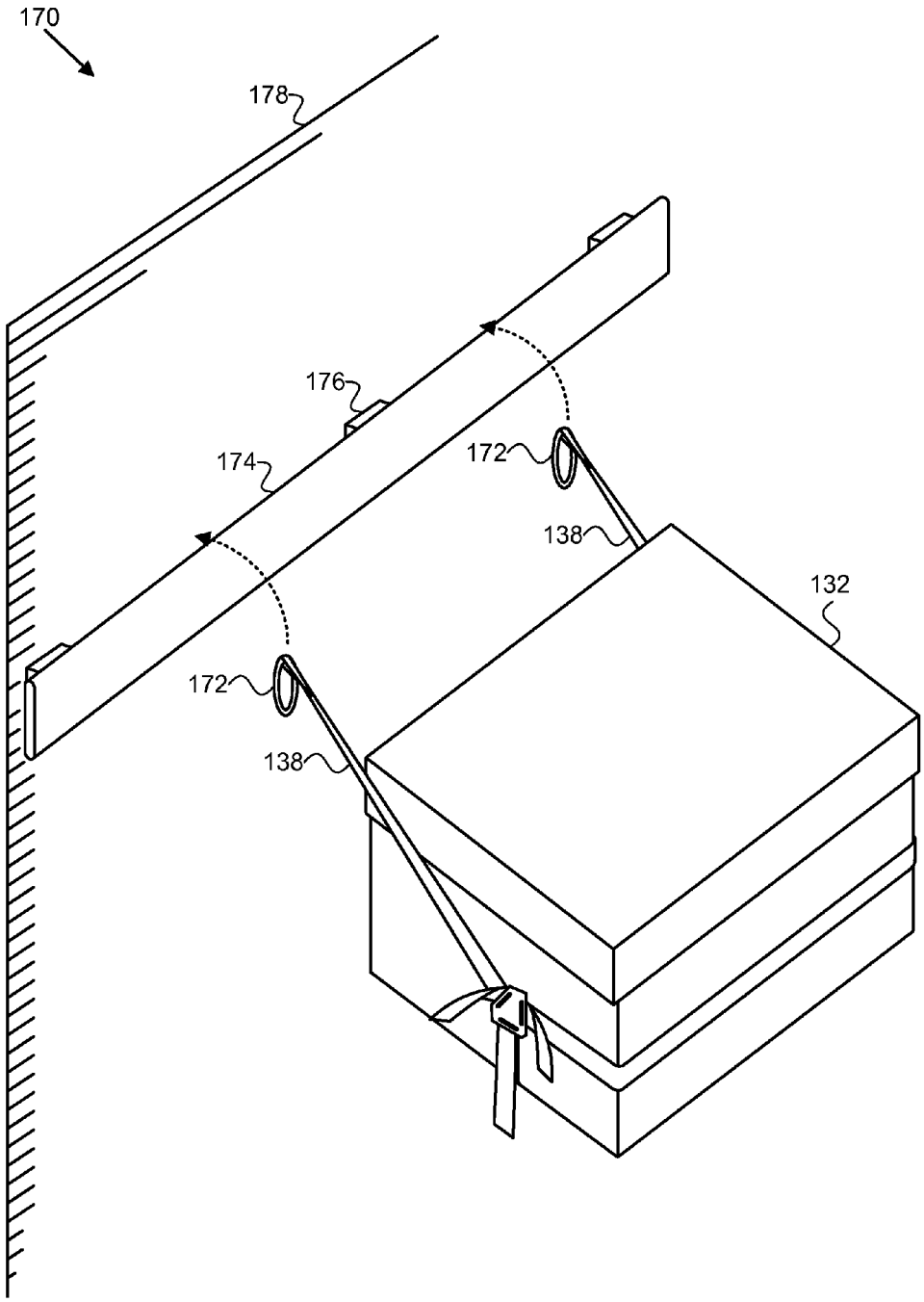
FIG. 7 depicts a schematic diagram of a storage system with straps, a storage device, and a mounting device.

FIG. 7 depicts one embodiment of a storage system 170. The storage system 170 includes ring elements 172 coupled to the mounting members 138. The ring elements 172 facilitate the mounting of the box 132 to the beam 174. The beam 174 is attached to the wall 178 with spacers 176 to create a space between the wall 178 and the corresponding side of the beam 174. The space between the wall 178 and the beam 174 allows the ring elements 172 to be inserted into the space and bind between the wall 178 and the beam 174 to support the weight of the box 132. The simplicity of the illustrated embodiment facilitates a relatively more intuitive use of the system by a user. For example, if the user has loaded the box 132 and secured the hanging system on the box 132, the ring elements 172 can relatively easily be slid behind the beam 174 by the user. Therefore, the functionality of the system 170 is such that, in general, it can be operated by a single user and provide adjustability to fit and hang a wide array of box 132 or other types of containers or items in both size and weight.

Figure 8:
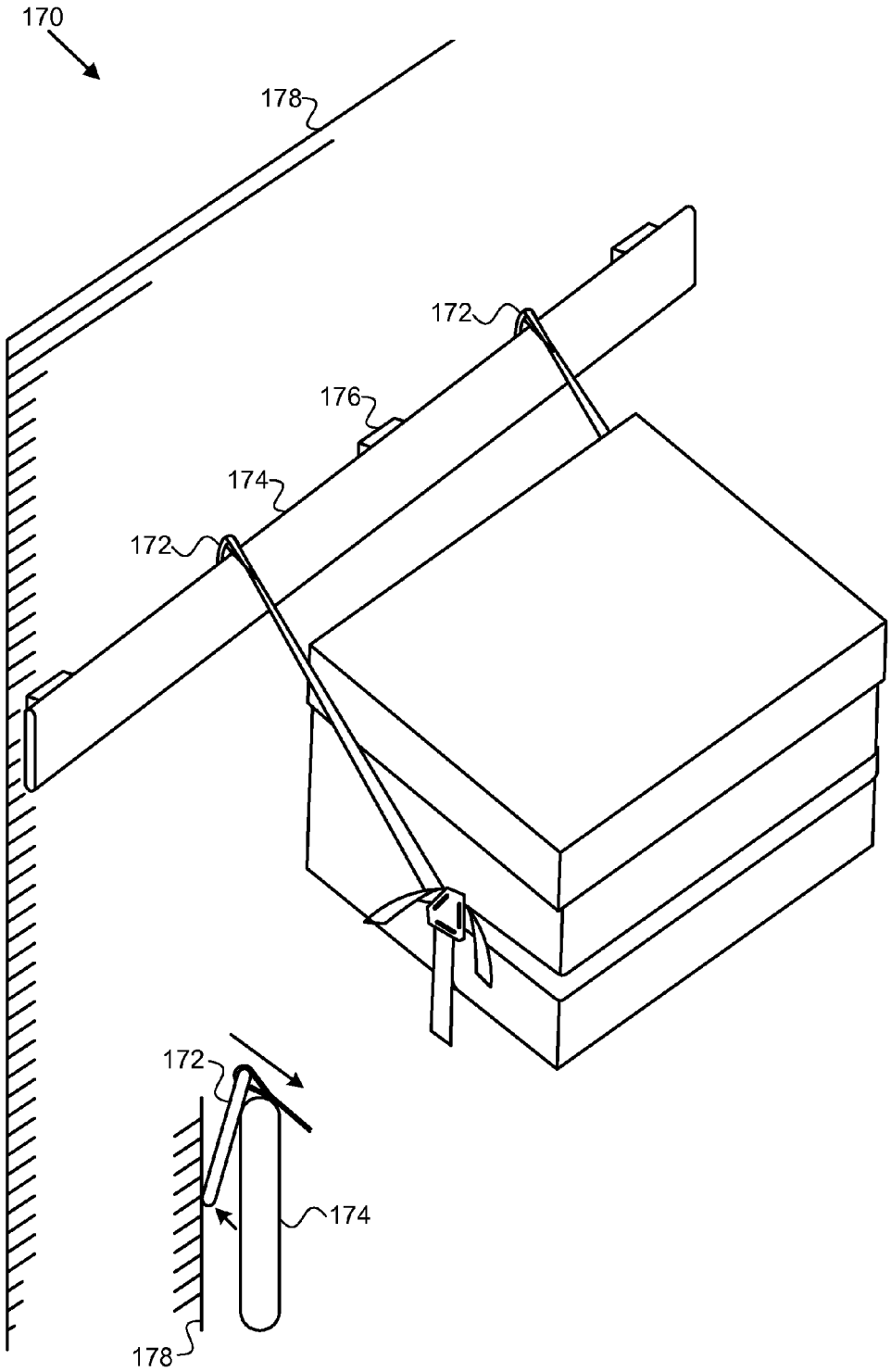
FIG. 8 depicts a schematic diagram of a storage system with straps, a storage device, and a mounting device in a mounted configuration.

FIG. 8 illustrates the storage system 170 of FIG. 7 with the ring element 172 inserted between the wall 178 and the beam 174. Additionally, FIG. 8 illustrates a cross-sectional view of the arrangement of the ring element 172 inserted between the beam 174 and the wall 178 with the illustrated arrows depicting a general direction of forces acting from the ring element 172. In another embodiment, the ring element 172 is attached to a hook (not shown) that is mounted to the wall 178. Another embodiment includes hooking the loop of the mounting member 138 (as illustrated in FIG. 5) directly onto a wall-mounted hook (not shown). Other embodiments incorporate other mounting means 136.

Figure 9:
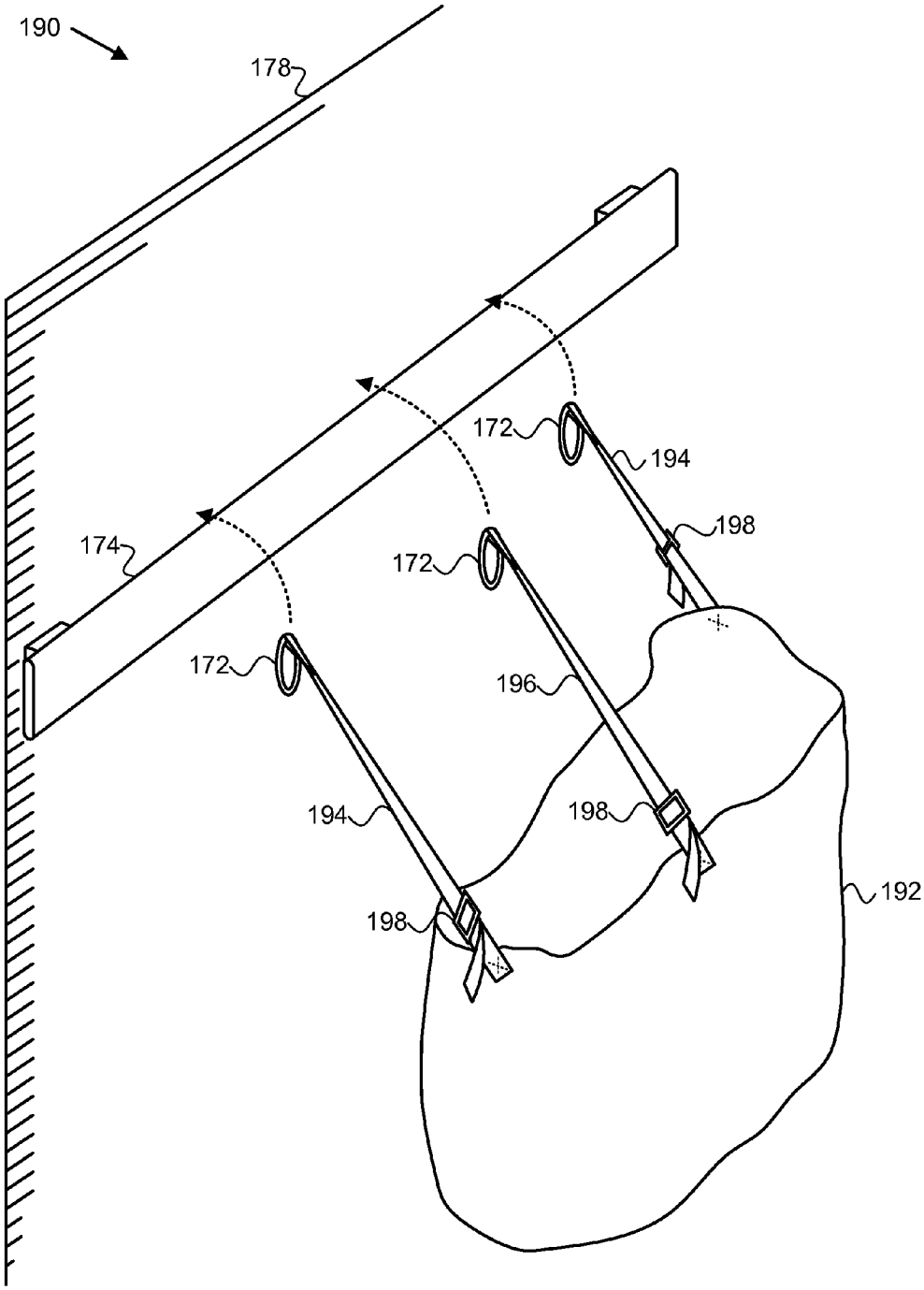
FIG. 9 depicts a schematic diagram of a storage system with straps, a storage device, and a mounting device.

FIG. 9 illustrates a bag system 190. The bag system 190 includes the ring elements 172 attached to two side mounting members 194. The ring elements 172 function as described in FIG. 8. The illustrated embodiment also includes a closure member 196 to draw the bag 192 closed when the bag 192 is hung on the beam 174. In some embodiments, the closure member 196 is sewn on a portion of the bag 192. In another embodiment, the closure member 196 is integrated into a drawstring (not shown) to close the top of the bag 192. In some embodiments, each of the members 194 and 196 has an adjustment retainer 198. The retainers 198 facilitate adjustment of the length of the members 194 and 196. Other embodiments of the bag system 190 may include more or fewer members 194 and 196.

Figure 10:
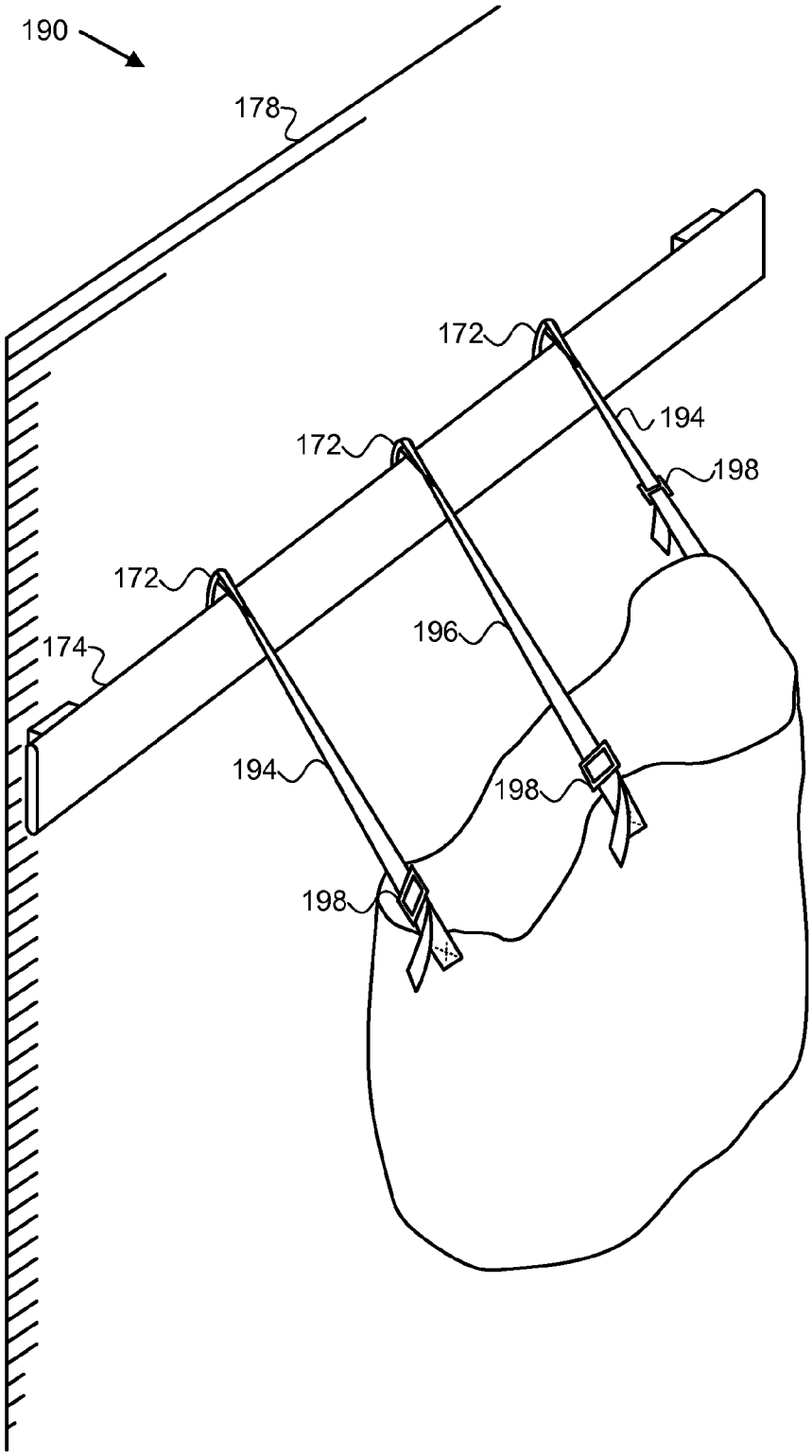
FIG. 10 depicts a schematic diagram of a storage system with straps, a storage device, and a mounting device in a mounted configuration.

FIG. 10 illustrates the bag system 190 with the ring elements 172 inserted between the beam 174 and the wall 178. In one embodiment, the bag system 190 has an internal frame (not shown) to form a geometry in at least a portion of the bag 192.

Figure 11:
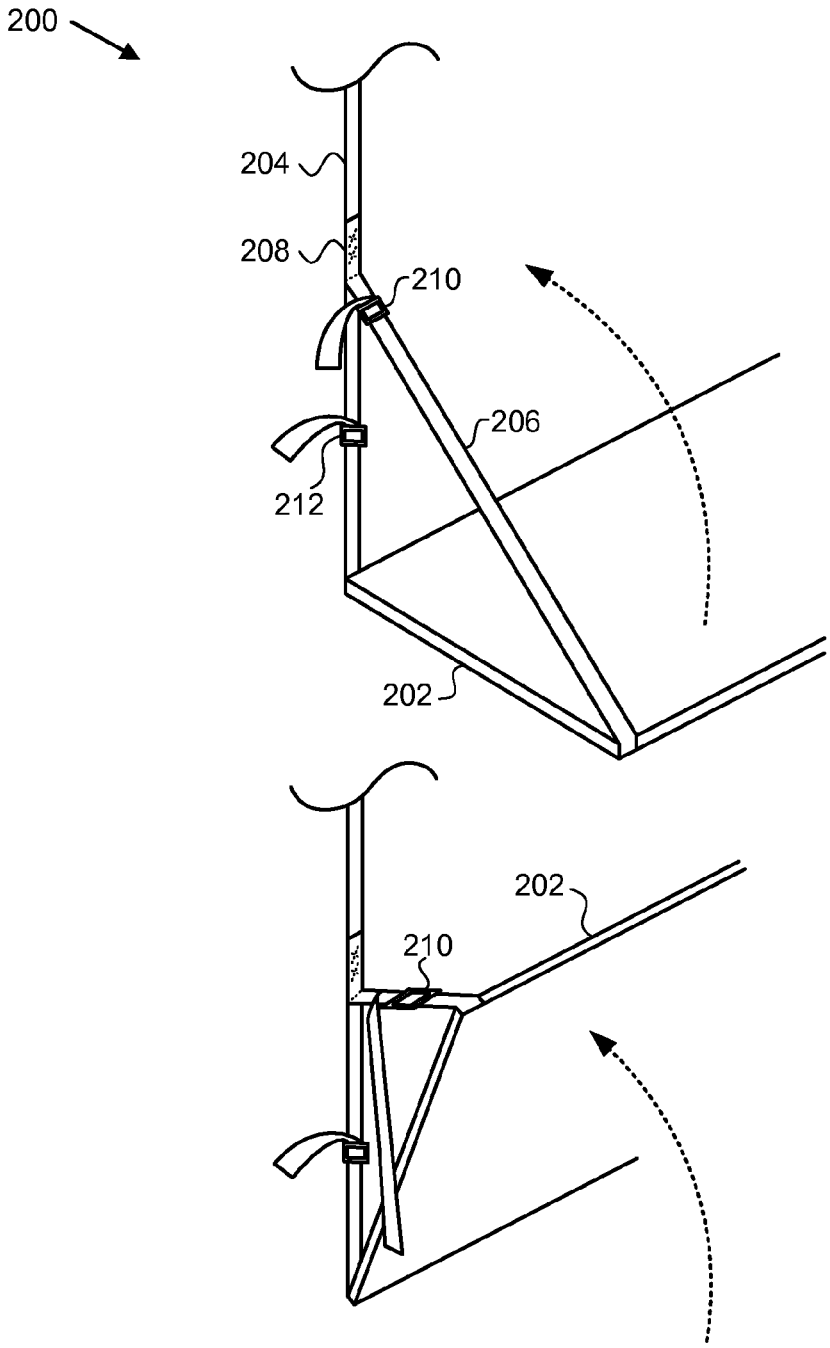
FIG. 11 depicts schematic diagram of a shelf system.

FIG. 11 illustrates one embodiment of a shelf system 200. In the illustrated embodiment, the shelf system 200 includes a shelf element 202, a mounting member 204, and a support member 206. In some embodiments, the shelf element 202 is supported by the mounting member 204 and the support member 206. The mounting member 204 and the support member 206 are coupled at a joining portion 208. In some embodiments, the joining portion 208 is formed by sewing the support member 206 to the mounting member 204. In other embodiments, other manners of coupling the support member 206 and the mounting member 204 form the joining portion 208. The support member 206 also includes a support member retainer 210. The support member retainer 210 facilitates adjustment in the length of the support member 206. This functionality allows the adjustment of the support member 206 to raise the shelf element 202 into a substantially upright position. In some embodiments, the mounting member 204 includes a mounting member retainer 212 to facilitate adjustment of the mounting member 204 to raise and lower the level of the shelf element 202. This allows the shelf element 202 to be raised into the substantially vertical position when not in use, thus, saving space.

Figure 12A:
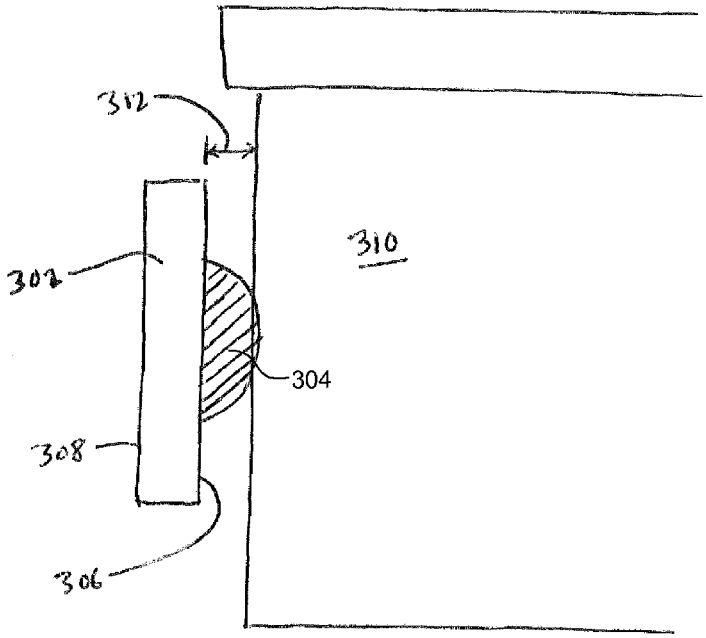
FIG. 12A depicts a schematic diagram of a connector with a protrusion.
Figure 12B:
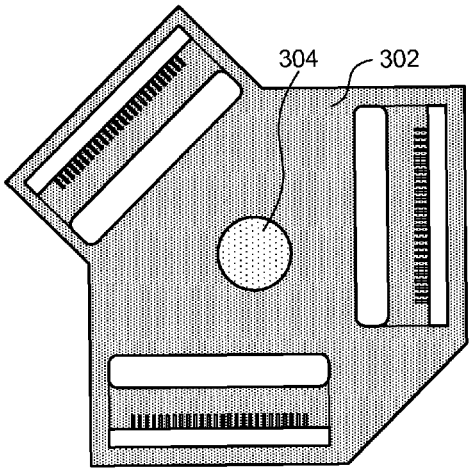
FIG. 12B depicts a schematic diagram of a connector with a protrusion located at a center of the corresponding surface of the connector.
Figure 12C:
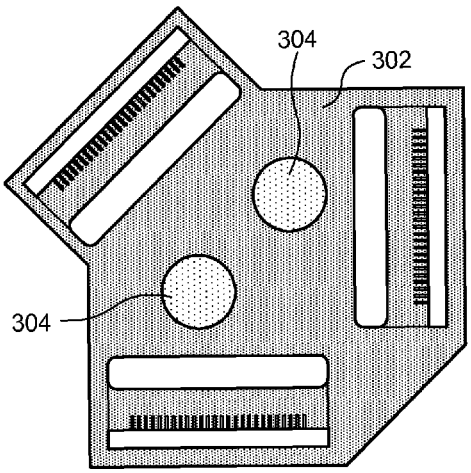
FIG. 12C depicts a schematic diagram of a connector with a protrusion located offset from the center of the corresponding surface of the connector.

FIG. 12A illustrates one embodiment of the connector 302. The depicted embodiment shows a side-view of a connector 302 positioned against a box or other storage device 310. The connector 302 has a first and second surface 306 and 308. A protrusion 304 creates a space between the connector 302 and the storage device 310, thereby creating a space 312 between at least a portion of a surface 306 of the connector 302 and the storage device 310. This space 312 increases accessibility to the connector 302 for purposes of attachment, detachment, loosening, or tightening the straps or securing mechanism. In some embodiments, the connector 302 could have a multiple protrusions on a surface of the connector 302. In other embodiments, protrusions may be located on multiple surfaces of the connector 302. In some embodiments, the protrusion could be curved or flat, or a variety of shapes. FIG. 12B depicts a schematic diagram of a connector with a protrusion located at a center of the corresponding surface of the connector. GIG. 12C depicts a schematic diagram of a connector with a protrusion located offset from the center of the corresponding surface of the connector.

Figure 13:
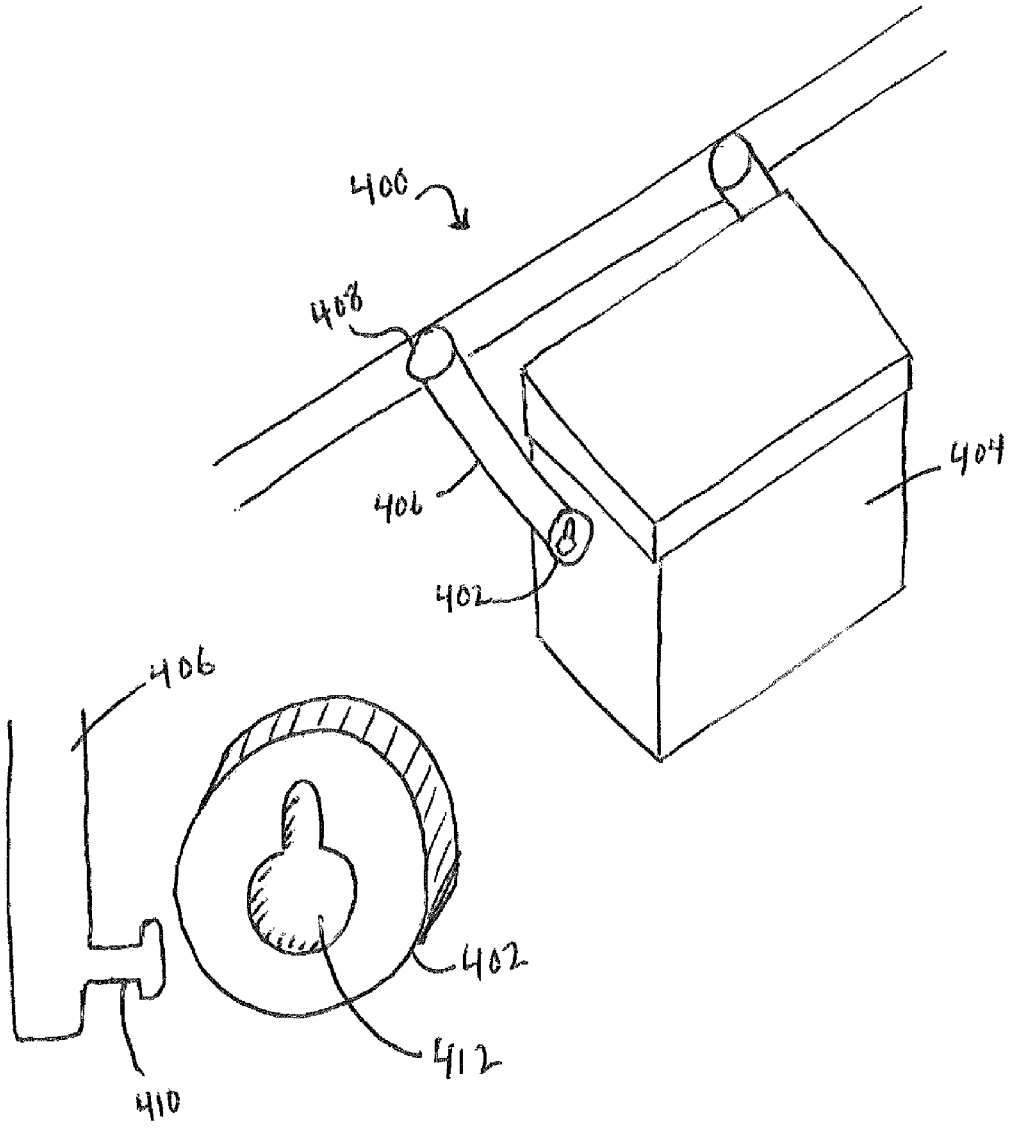
FIG. 13 depicts a schematic diagram of storage system with connection fixtures on a storage device.

FIG. 13 illustrates one embodiment of a storage system 400. The illustrated embodiment of the storage system 400 facilitates the mounting of a box 404 to a wall or semi-vertical surface. The system 400 is coupled to the wall by means of a mounting member 406. Connecting fixtures 402 are mounted on opposite sides of the box 404. The connecting fixture 402 also has a connection point 412 at which the mounting member connects by means of a connecting member 410.

The connecting fixture 402 may be any form of securing mechanism, such as a magnet, slider, lockable slider, clamp, roller, hook, block, hole, clip, or other mechanical interfacing or hanging device by which a connecting member 410 may attach. Additionally, the connecting member 410 may secure to the connection point by means of a magnet, screw, nail, hook, block, clip, or other device configured to attach to the connection point 412. Additionally, the connecting member 410 may be configured to attach or detach thereby increasing the ease of removing or adding more storage to the wall. In the illustrated embodiment, the connection fixture 402 is a device configured to attach to the mounting member 406 by means of a screw or other flat-head device that slides or attaches to the connection fixture 402.

Figure 14:
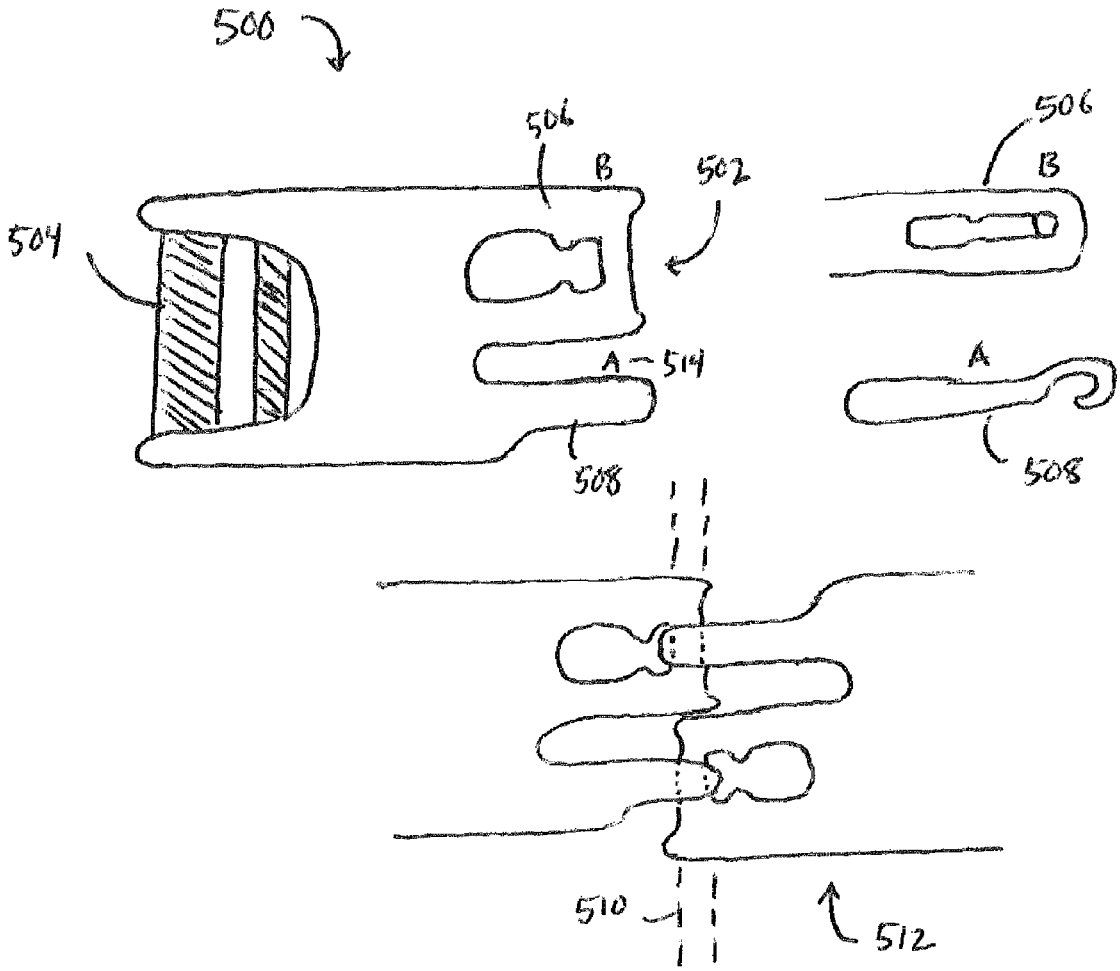
FIG. 14 depicts a schematic diagram of a connection device.

FIG. 14 illustrates one embodiment of a connector 500 with rotating capabilities. The depicted embodiment shows an overhead view of the connector 500 which may also include a strap adjustor 504 and may connect to another connector 500 by means of a connection mechanism 502. The connection mechanism 502 has a receiving member 506 and an attaching member 508. The illustrated embodiment also shows how two connectors 500 attach by means of interacting connection mechanisms 502 in which an attaching member 508 of a first connector 500 connects to a receiving member 506 of a second connector 500 while an attaching member 508 of a second connector 500 connects to a receiving member 506 of a first connector 500. To facilitate the ease of connection, the illustrated embodiment also includes a notch 514 so that the connectors 500 may approach from an angle, and connect simultaneously if desired. Once connected, the pair of connectors 500 creates an axis of rotation 510 around which the connectors 500 may rotate in two directions allowing for flexibility and an increased number of applications of the connector 500.

In the above description, specific details of various embodiments are provided. However, some embodiments may be practiced with less than all of these specific details. Although specific embodiments of the invention have been described and illustrated, the invention is not to be limited to the specific forms or arrangements of parts so described and illustrated. The scope of the invention is to be defined by the claims appended hereto and their equivalents.

What is claimed is:

1. An apparatus for hanging a storage device, the apparatus comprising:

a plurality of mounting straps;

a frontal strap oriented to support the storage device, wherein the frontal strap is configured to at least partially wrap around the storage device;

a lower strap oriented to support at least a portion of the weight of the storage device, wherein the lower strap is configured to at least partially wrap around a bottom portion of the storage device; and a connector with a plurality of connectors, each connector comprising multiple connection points, wherein the plurality of connectors comprises:

a first connector to connect a first mounting strap, a first end of the frontal strap, and a first end of the lower strap at the multiple connection points of the first connector; and a second connector to connect to a second mounting strap, a second end of the frontal strap, and a second end of the lower strap at the multiple connection points of the second connector.

2. The apparatus of claim 1, further comprising:

a mounting rail; and a mounting hardware, wherein the mounting strap is coupled to the mounting rail by the mounting hardware.

3. The apparatus of claim 2, wherein the mounting hardware comprises a ring.

4. The apparatus of claim 3, wherein the mounting hardware comprises a D-ring.

5. The apparatus of claim 1, further comprising a wrapping strap to wrap around at least a portion of a perimeter of the storage device.

6. The apparatus of claim 1, the multiple connection points of each connector comprising:

a first strap attachment structure facing outward from the three-way connector device;

a second strap attachment structure facing outward from the three-way connector device in substantially the same plane as the first strap attachment structure, wherein the second strap attachment structure is oriented at a first angle with respect to the first strap attachment structure, wherein the first and second strap attachment structures are a unitary device; and a third strap attachment structure facing outward from the three-way connector device in substantially the same plane as the first and second strap attachment structures, the third strap attachment structure oriented at a second angle with respect to the first strap attachment structure and a third angle with respect to the second strap attachment structure.

7. The apparatus of claim 6, wherein the first, second, and third angles are fixed, wherein the first angle is approximately a 90 degree angle, the second angle is approximately a 135 degree angle, and the third angle is approximately a 135 degree angle.

8. The apparatus of claim 6, wherein the third attachment structure is adjustable with respect to the first and second strap attachment structures.

9. The apparatus of claim 6, wherein the first, second, and third strap attachment structures are a unitary device.

10. The apparatus of claim 6, wherein the first, second, and third strap attachment structures comprise strap adjusters.

11. The apparatus of claim 6, wherein the first, second, and third strap attachment structures comprise loop attachments.

12. The apparatus of claim 1, each connector comprising:

at least one protrusion which extends outward beyond a plane of the corresponding surface, configured to create a space between the corresponding surface and the storage device.

13. The apparatus of claim 12, wherein the at least one protrusion is located at the center of the corresponding surface of the connector.

14. The apparatus of claim 12, wherein the at least one protrusion is located offset from the center of the corresponding surface of the connector.

15. The apparatus of claim 6, wherein the first angle is fixed at approximately a 90 degree angle.

* * * * *